United States Patent [19]

Chou

[11] Patent Number: 4,846,758

[45] Date of Patent: Jul. 11, 1989

[54] ERRATIC TOY VEHICLE WITH BODY TILT MECHANISM

[76] Inventor: Jin-Long Chou, 1st, 2nd Fl., 3, Alley 27, Lane 629, Nei-Hu Road, Taipei, Taiwan

[21] Appl. No.: 148,365

[22] Filed: Jan. 25, 1988

[51] Int. Cl.[4] ..... A63H 17/00; A63H 17/26

[52] U.S. Cl. ..... 446/437; 446/469

[58] Field of Search ..... 446/437, 460, 461, 462, 446/457, 454, 455, 469

[56] References Cited

U.S. PATENT DOCUMENTS

| | | | |
|---|---|---|---|
| 2,104,365 | 1/1938 | Fuchs | 446/460 |
| 2,121,355 | 6/1938 | Krupp | 446/460 |
| 2,461,672 | 2/1949 | Adamczyk | 446/460 |
| 2,587,052 | 2/1952 | Lohr | 446/460 |
| 2,606,402 | 8/1952 | Fuchs | 446/437 X |
| 3,871,129 | 3/1975 | Tong | 446/437 X |
| 3,984,939 | 10/1976 | Wolgamot et al. | 446/437 X |
| 4,156,986 | 6/1979 | Kupperman et al. | 446/462 |
| 4,373,290 | 2/1983 | Goldfarb et al. | 446/462 X |
| 4,443,967 | 4/1984 | Jones et al. | 446/462 |
| 4,585,423 | 4/1986 | Kwan | 446/437 X |

*Primary Examiner*—Mickey Yu
*Assistant Examiner*—D. Neal Muir
*Attorney, Agent, or Firm*—Lowe, Price, LeBlanc, Becker & Shur

[57] ABSTRACT

A toy stunt race car is described. The device includes a fifth wheel having an axis of rotation lower than the axis of rotation for the conventional four wheels of the car. The fifth wheel is driven by a motor and its mount also is caused to rotate. The fifth wheel then makes a three point contact with the surface including only two of the car wheels. As the fifth wheel mount continues to rotate, different two wheels are involved so that the car either races forward, backward, or turns sharply to the left or to the right, depending upon where the driven fifth wheel is relative to the car during rotation of the mount therefore.

2 Claims, 5 Drawing Sheets

ERRATIC TOY VEHICLE WITH BODY TILT MECHANISM

BACKGROUND OF THE INVENTION

In today's fast growing society people demand better performance in everything. As a consequence, conventional toy cars are not well received because they are dull and uninteresting. Conventional toy cars normally can go only in a single direction or when equipped with a turning movement do not simulate to any great degree the action of a full size vehicle.

In view of these shortcomings, the present invention is designed to provide a fifth wheel rotatably mounted beneath the car having an axis of rotation below that of the conventional four wheels. In addition, the fifth wheel is mounted on a rotating assembly. This arrangement then provides a lifelike motion similar to those of genuine stunt race cars.

SUMMARY OF THE INVENTION

The present invention provides a structure for a stunt toy race car which uses a motor to drive both a fifth wheel and cause an assembly mounting said wheel to rotate. The fifth wheel and two of the conventional wheels on the toy car then provide three bearing points and while the fifth wheel rotates a different pair of wheels become involved in supporting the car to imitate the motion of full size stunt race cars.

DETAILED DESCRIPTION OF THE PREFERRED EMBODIMENT

Figure 1:
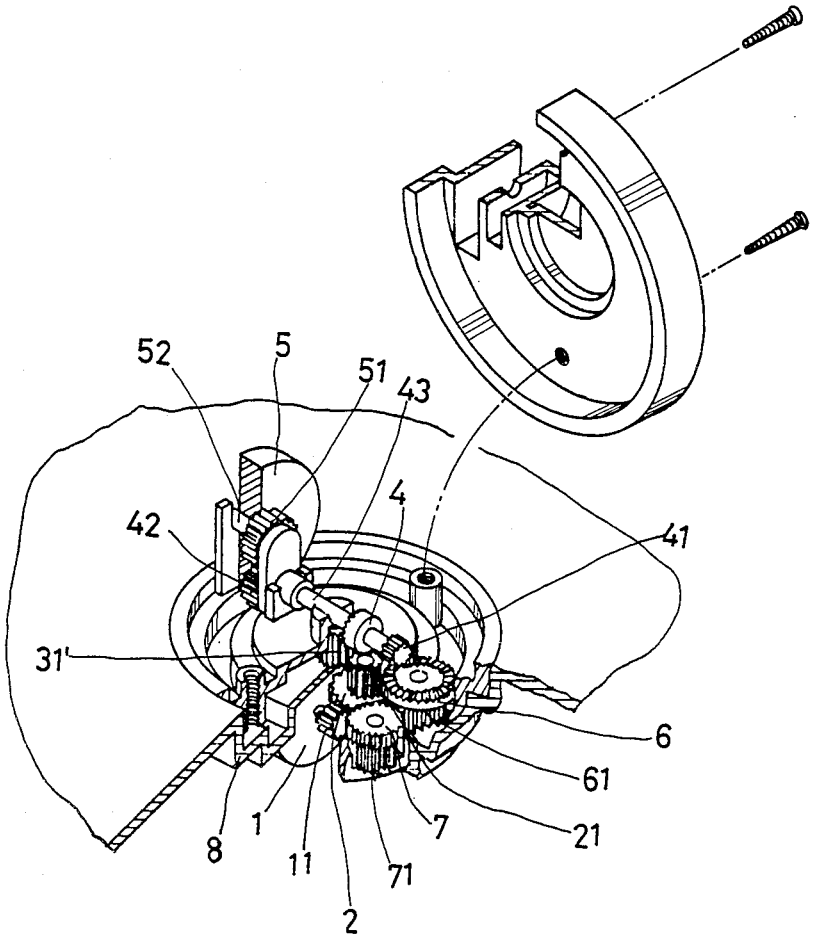
FIG. 1 is a fragmentary bottom view partially exploded of the drive system for the car of this invention.
Figure 2:
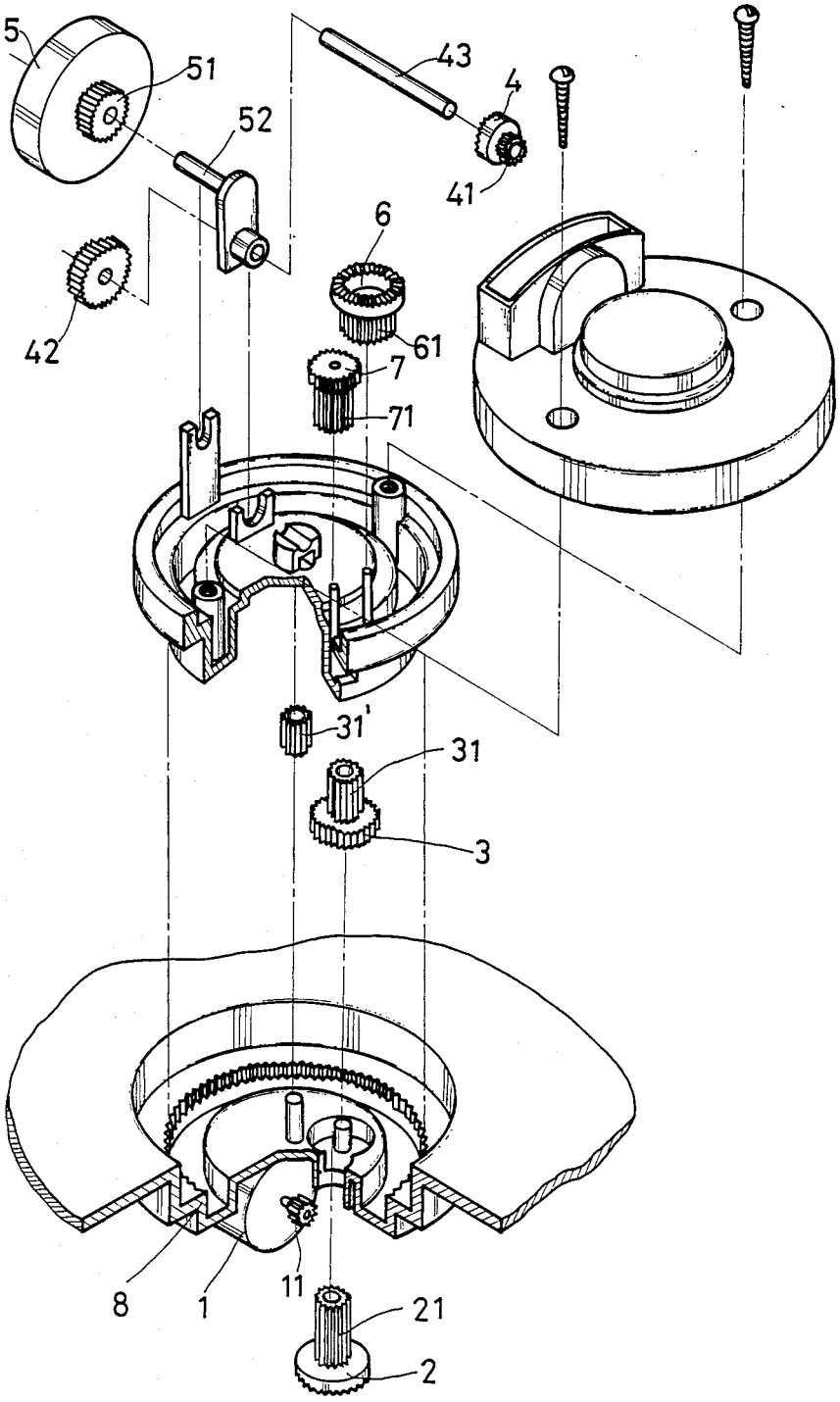
FIG. 2 is an exploded fragmentary view of the drive system of FIG. 1.

With reference to FIGS. 1 and 2, a gear 11 is mounted on the drive shaft of a motor 1. Gear 11 in turn engages a gear wheel disk 2 and said gear wheel disk 2 in turn engages long gear 21. Long gear 21 also engages another gear 3 and gear 3 is attached to gear 31 which in turn engages gear 31'. Long gear 31, 31' engages crown wheel 4 which is mounted on shaft 43. Another gear 41 is also fixed to crown wheel 4 and this gear engages gear wheel disk 6. Another gear 61 is fixed to gear wheel disk 6 which in turn engages gear wheel 7. Gear wheel 7 mounts long gear 71 which in turn engages ring gear 8. Gear 71 then is an epicyclic gear internal to ring gear 8 and is mounted on post 9 which in turn is affixed to assembly base 10 which in turn is rotatably mounted on post 12 so that as gear 71 is driven it will cause assembly 10 to rotate.

A gear 42 is mounted on crown wheel shaft 43 and engages gear 51. Gear 51 is mounted on rotating wheel 5 coaxially on shaft 52. Rotation of the motor shaft 11 then will cause both wheel 5 to rotate on shaft 52 and asesmbly 10 to rotate as epicyclic gear 71 rotates about ring gear 8.

Figure 3:
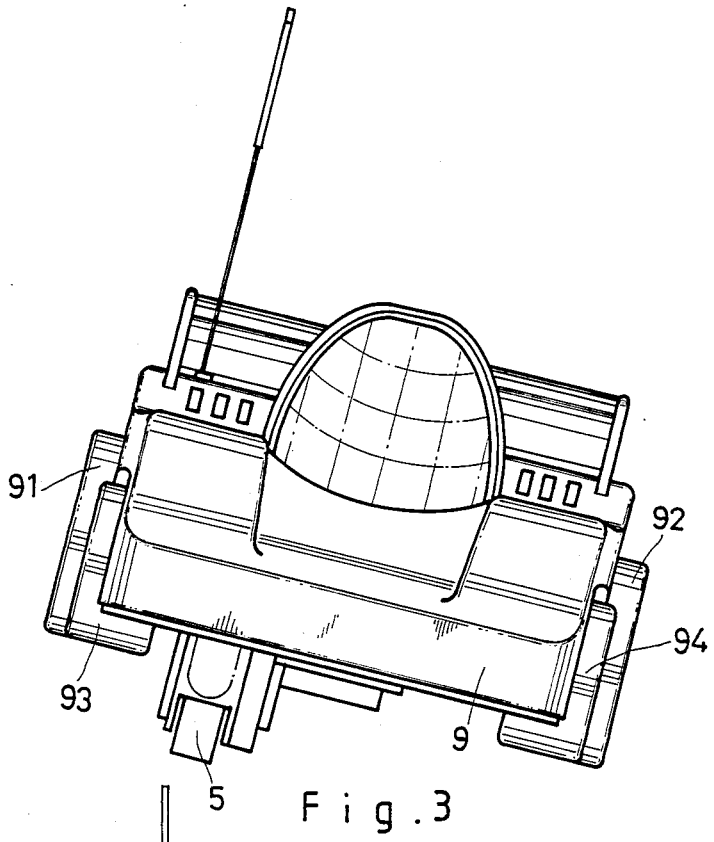
FIG. 3 is a front view of the toy car of this invention illustrating one attitude.
Figure 4:
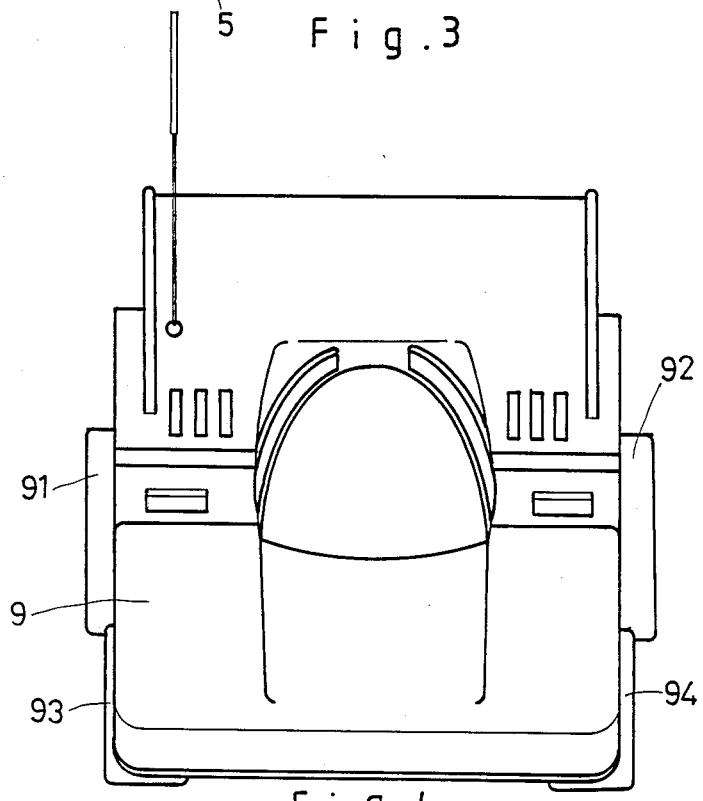
FIG. 4 is a front view similar to FIG. 3 illustrating a different attitude of the toy vehicle.
Figure 5:
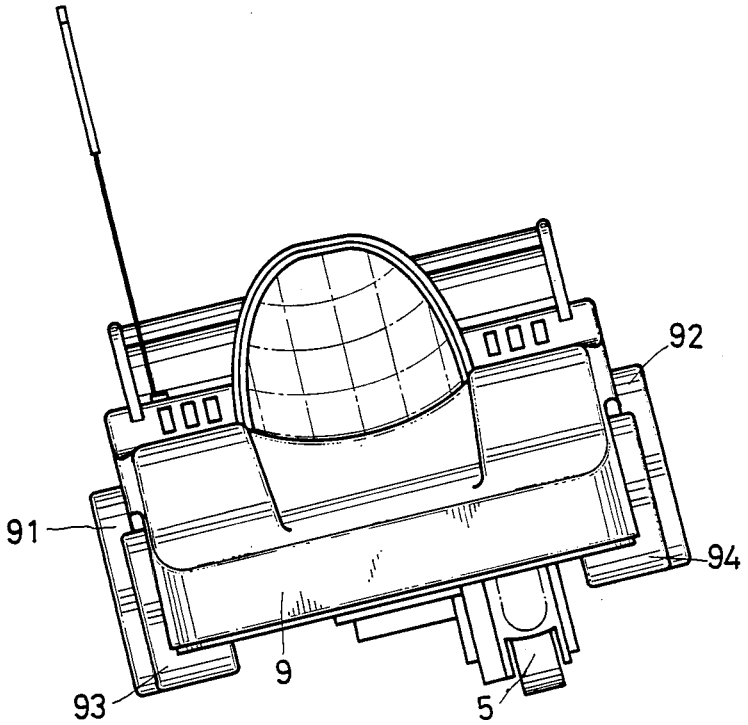
FIG. 5 is a front view similar to FIG. 3 illustrating a different attitude of the toy vehicle.
Figure 6:
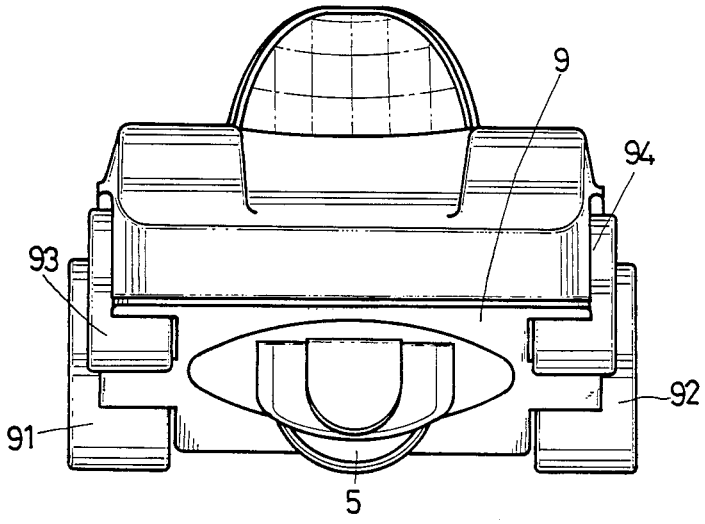
FIG. 6 is a perspective view of the toy car of this invention illustrating yet another attitude of the vehicle.

Due to the different gear systems, when motor 1 drives the gears, rotation of the assembly 10 about ring gear 8 will be relatively slow while rotation of wheel 5 will be relatively fast. The position of wheel 5 then as shown for example in FIGS. 3 and 5, is below that of car wheels 91, 92, 93 and 94. In other words, the axis of rotation of wheel 5 is lower than that of the car wheels. Because rotating wheel 5 rotates as base 10 rotates, and because the axis of rotation of wheel 5 is lower than the axis of the car wheels 91, 92, 93 and 94, the car can make four different motions as base 10 rotates. As shown in FIGS. 3 and 5, the three point position can be formed by wheel 5 and two side wheels 92 and 94 or wheel 5 and wheels 91 and 93. In one position the car will be moving forward and in another the car will be moving backward. As will be obvious to those skilled in the art, if the three point position is formed between wheel 5 and for example rear wheels 91 and 92 as shown in FIG. 6, the car will turn. Therefore, as the car is driven it continuously makes sudden turning movements to the left or to the right or runs fast in a forward or rearward direction so as to make the toy car more interesting and to simulate a stunt race car in performance.

Figure 7:
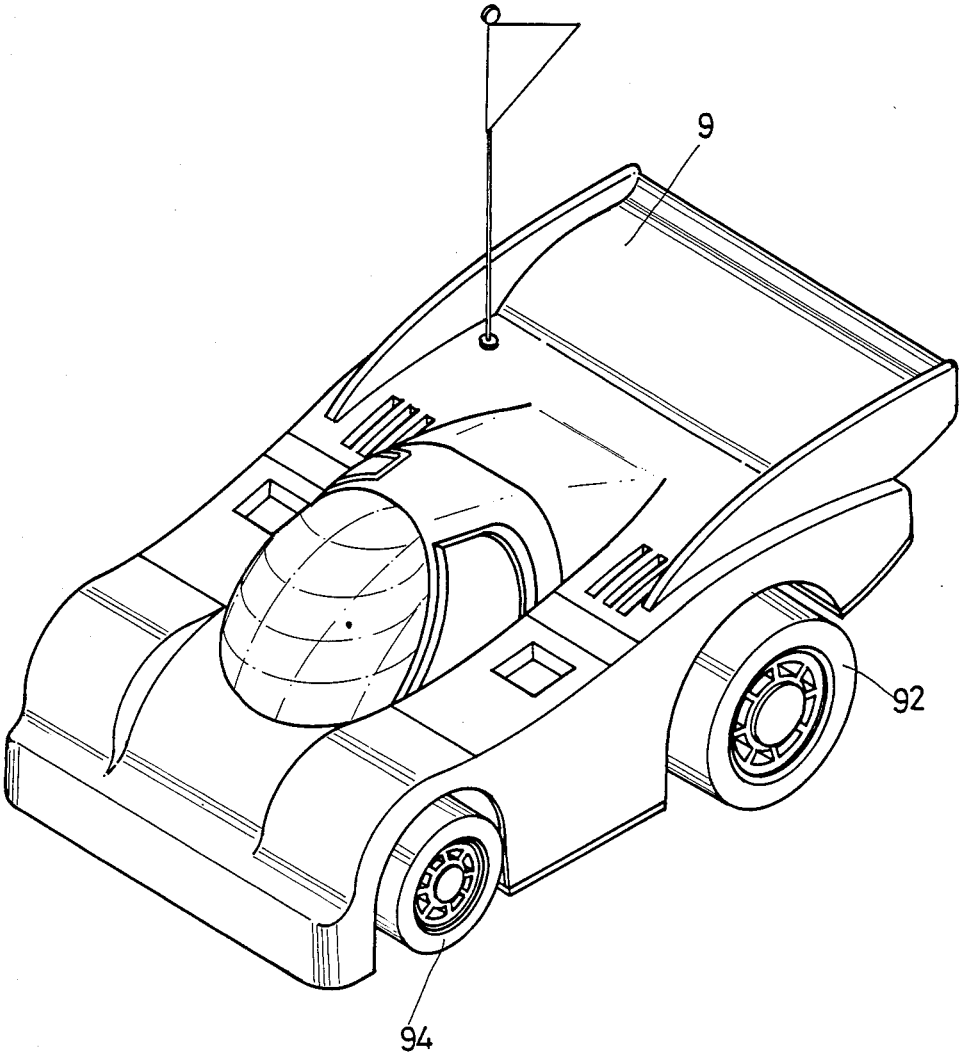
FIG. 7 is a perspective view of the preferred embodiment of the vehicle of this invention.

With reference to FIG. 7, the power source for the motor is arranged according to the type of car as will be obvious to those skilled in the art. A battery is normally used as a power source and the battery and a switch for turning the car on are not shown but the disposition thereof would be obvious to those skilled in the art.

The invention may be embodied in other specified forms without departing from the spirit or essential characteristics thereto. The present embodiments are therefore to be considered in all respects as illustrative and not restrictive, the scope of the invention being indicated by the appended claims rather than by the foregoing description, and all changes which may come within the meaning and range of equivalency of the claims are therefore intended to be embraced therein.

I claim:

1. A toy car comprising:

a cart body having four wheels rotatably attached thereto;

a motor disposed within said body adapted to be coupled to a source of energy;

a fifth wheel rotatably mounted on a base assembly in the bottom of said car, said fifth wheel having an axis of rotation disposed below the axis of rotation of the four car wheels;

means coupling said motor and said fifth wheel, and said motor and said base assembly for driving said fifth wheel in rotation and for simultaneously causing said wheel mount based assembly to rotate relative to said car body so that said car is always supported by only two of said four wheels and said fifth wheel and as said wheel mount base rotates the supporting two wheels change.

2. The toy car of claim 1 wherein said base is circular and is disposed in a circular recess in said car body and said means for rotating includes a ring gear surrounding said base and an epicyclic gear rotatably mounted on said base meshing with said ring gear.

* * * * *